US012281858B2

(12) United States Patent
Dulberg

(10) Patent No.: US 12,281,858 B2
(45) Date of Patent: Apr. 22, 2025

(54) COMPACT HEAT EXCHANGER

(71) Applicant: WATERGEN LTD., Petah Tiqwa (IL)

(72) Inventor: Sharon Dulberg, Beer Sheva (IL)

(73) Assignee: WATERGEN LTD., Petah Tiqwa (IL)

( * ) Notice: Subject to any disclaimer, the term of this patent is extended or adjusted under 35 U.S.C. 154(b) by 192 days.

(21) Appl. No.: 18/012,869

(22) PCT Filed: Jun. 24, 2021

(86) PCT No.: PCT/IL2021/050780
§ 371 (c)(1),
(2) Date: Dec. 23, 2022

(87) PCT Pub. No.: WO2021/260706
PCT Pub. Date: Dec. 30, 2021

(65) Prior Publication Data

US 2023/0251042 A1 Aug. 10, 2023

Related U.S. Application Data

(60) Provisional application No. 63/043,238, filed on Jun. 24, 2020.

(30) Foreign Application Priority Data

Mar. 22, 2021 (IL) ..... 281733

(51) Int. Cl.
*F28D 1/04* (2006.01)
*F28D 1/02* (2006.01)
(Continued)

(52) U.S. Cl.
CPC ..... *F28D 9/0068* (2013.01); *F28D 1/024* (2013.01); *F28D 1/053* (2013.01); *F28F 1/325* (2013.01); *F28D 2021/0038* (2013.01)

(58) Field of Classification Search
CPC ..... F28D 9/0068; F28D 1/024; F28D 1/053; F28D 2021/0038; F28F 1/325
(Continued)

(56) References Cited

U.S. PATENT DOCUMENTS 5,062,475 A * 11/1991 Bemisderfer ..... F28F 1/34 165/181
5,727,623 A 3/1998 Yoshioka et al.
(Continued)

FOREIGN PATENT DOCUMENTS

JP H0682038 B2 * 10/1994
JP 2002206890 A * 7/2002

*Primary Examiner* — Davis D Hwu
(74) *Attorney, Agent, or Firm* — PEARL COHEN ZEDEK LATZER BARATZ LLP

(57) ABSTRACT

A heat exchanger having a fins and tubes heat exchanger coupled to a plates heat exchanger and an open sided bypass compartment facing one of the edges of the fin and tubes heat exchanger. The plates heat exchanger has an inlet zone and an outlet zone. The heat exchanger is configured to guide a fluid to flow from the inlet zone, through inlet pathways between plates of the plates heat exchanger, and fins of the fins and tubes heat exchanger then toward the bypass compartment, then in between the fins facing outlet pathways, toward in between the surfaces of the plates facing the outlet pathways, and then toward the outlet zone.

15 Claims, 2 Drawing Sheets

(51) Int. Cl.

| | |
|---|---|
| ***F28D 1/053*** | (2006.01) |
| ***F28D 9/00*** | (2006.01) |
| ***F28F 1/32*** | (2006.01) |
| *F28D 21/00* | (2006.01) |

(58) Field of Classification Search
USPC ..... 165/151
See application file for complete search history.

(56) References Cited

U.S. PATENT DOCUMENTS

| | | | |
|---|---|---|---|
| 11,578,930 | B2 | 2/2023 | Nakamura et al. |
| 2004/0094291 | A1 | 5/2004 | Memory et al. |
| 2010/0107675 | A1 | 5/2010 | Lifson et al. |
| 2017/0211889 | A1 | 7/2017 | Schwalm |
| 2019/0154350 | A1 | 5/2019 | Dulberg et al. |

* cited by examiner

COMPACT HEAT EXCHANGER

TECHNICAL FIELD

The present invention relates to the field of heat exchangers. More particularly, the invention relates to fins and tubes and plates heat exchanger an apparatus comprising said heat exchanger.

BACKGROUND OF THE INVENTION

Fins and tubes heat exchangers as well as plates heat exchanges are well known. Heat exchangers made of a fins and tubes heat exchanger coupled to a plates heat exchanger were described in the literature. There is a need for compacted fins and tubes heat exchanger coupled to a plates heat exchanger which may have a significantly reduces the volume.

SUMMARY OF THE INVENTION

The invention relates to a heat exchanger comprising a fins and tubes heat exchanger, a plates heat exchanger having an inlet zone and an outlet zone and an open sided bypass compartment defining an enclosure. The fins and tubes heat exchanger includes a plurality of stacked fins each having at least one through hole coupled with a penetrating heat exchanging tube. The tubes convey external thermal fluid, the fins and the tubes transfer heat between the external thermal fluid and a fluid flowing in between the fins. The plates heat exchanger comprises a plurality of stacked plates configured to transfer heat from one side of the surface of the plate to the other side of the surface of the plate. Each fin is coupled to a plate on an edge of the fin and one of the edges of the fin faces the open side of the bypass compartment. Each plate is coupled to a fin on an edge of the plate, one of the edges of the plate faces at least one of the inlet zone and the outlet zone. In some embodiments only a portion of the plates are coupled to fins, and in some embodiments only a portion of the fins are coupled to plates. The term coupled means that the two components, i.e. the plate and the fin, are in such proximity, that they create a continuous surface for a fluid to flow over a first components to over the second component. Coupling can be achieved by attaching the plate to the fin, affixing, annealing, or just bringing the two parts into contact.

Each coupled plate and fin defines a gap with an adjacent coupled plate and fin. The gap is either an inlet pathway for a fluid that enters the inlet zone or an outlet pathway for a fluid exiting through the outlet pathway. In an inlet pathway, the portion of the gap between two adjacent plates facing the inlet zone is open and the portion of the gap between the same two adjacent plates facing the outlet zone is blocked. In an outlet pathway, the portion of the gap between two adjacent plates facing the outlet zone is open, the portion of the gap between the same two adjacent plates facing the inlet zone is blocked. The inlet and outlet pathways are alternately stacked so that a counter flow (or semi-counter flow) is formed.

The heat exchanger is configured, by having the inlet and outlet pathways stacked and having the bypass compartment enclosing the space facing the outlets of the inlet pathways and the inlets of the outlet pathways, to guide a fluid flow to flow from the inlet zone, to in between the surfaces of the plates facing the inlet pathways, then toward in between the surfaces of the fins facing the inlet pathways, then out of the inlet pathway toward the bypass compartment, then toward in between the surfaces of the fins facing the outlet pathways, then toward in between the surfaces of the plates facing the outlet pathways, and then toward the outlet zone.

The inlet pathways and outlet pathways are alternately stacked, enabling the fluid in the inlet pathway and the fluid in the outlet pathway to be in mutual heat exchange propinquity.

A embodiment of the heat exchanger of the invention is well depicted in the accompanied figures below.

In some embodiments, the heat exchanger comprises a fins and tubes heat exchanger, a plates heat exchanger, and an open sided bypass compartment, wherein the fins and tubes heat exchanger is coupled to the plates heat exchanger having fins of the fins and tubes heat exchanger coupled to plates of the plates heat exchanger, the fins and tubes is further coupled to the bypass compartment, the coupled fins and plates define with adjacent coupled fins and plates alternating inlet pathways and outlet pathways being in fluid communication through the bypass compartment.

In some embodiments, the fins and tubes is coupled to a cooling source and the fluid in the inlet pathway is precooled upstream of said fins and tubes heat exchanger while a fluid in the outlet pathway is post-heated downstream of said fins and tubes heat exchanger.

In some embodiments the fins and tubes is coupled to a heating source and the fluid in the inlet pathway is preheated upstream of said fins and tubes heat exchanger while a fluid in the outlet pathway is post-cooled downstream of said fins and tubes heat exchanger.

In some embodiments plates of the plates heat exchangers are aligned and sealed with fins of the fins and tubes heat exchanger to define a plurality of continuous fluid pathways each pathway comprising a pair of coupled plate and fin.

The bypass compartment is in proximity to the fins and tube heat exchanger and distal from side of the fins and tubes heat exchanger that is coupled to the plates heat exchanger.

The plates of the heat exchanger can be made of a material having lower thermal conductivity than the material the fins are made of.

In some embodiments, the heat exchanger is configured to enable counter flow of the fluid flowing in the inlet pathway with the fluid flowing in the outlet pathway. To this end, the plates have protrusions adapted to guide the flow in a counter-flow manner having blocking protrusions as explained above and by an alternant configuration of the inlet and outlet pathways in the heat exchanger.

In a second aspect, the invention provides an apparatus comprising a housing for housing the heat exchanger as defined above together with a fluid propagating means. Without wishing to be limited thereto, the fluid propagating means can be for example a blower or a pump. Non-limiting examples for such apparatuses are a humidifier, an atmospheric water generator, a pasteurization apparatus and so forth. The plates and/or the fins can be embossed as to improve the energetic efficiency of the heat transfer between the fluids. In case that the apparatus is an atmospheric water generator it may include a sump for collecting water condensing in the heat exchanger and means for treating and distributing the condensate water. The sump may be located below the heat exchanger so that water will flow gravitationally toward the sump.

BRIEF DESCRIPTION OF THE DRAWINGS

The subject matter regarded as the invention is particularly pointed out and distinctly claimed in the concluding portion of the specification. The invention, however, together with objects, features, and advantages thereof, may best be understood by reference to the following detailed description when read with the accompanying drawings in which:

DETAILED DESCRIPTION OF THE PRESENT INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

This description of embodiments of the invention depicts a fins and tubes heat exchanger coupled to a plates heat exchanger in a novel configuration which significantly reduces the volume of said heat exchanger, making it compact and feasible to fit into various new applications.

Figure 1:
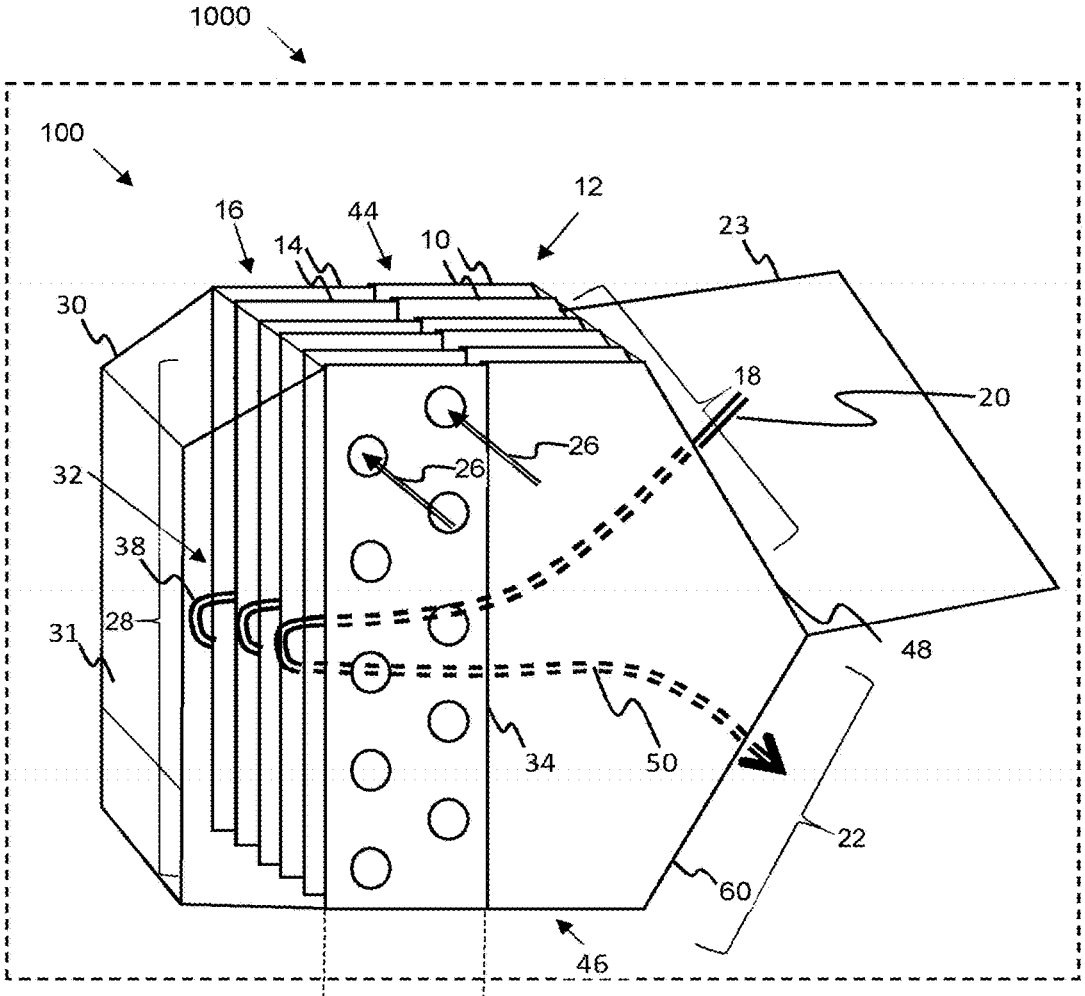
FIG. 1 is an isometric view of an apparatus installed with a heat exchanger according to some embodiments of the invention.
Figure 2:
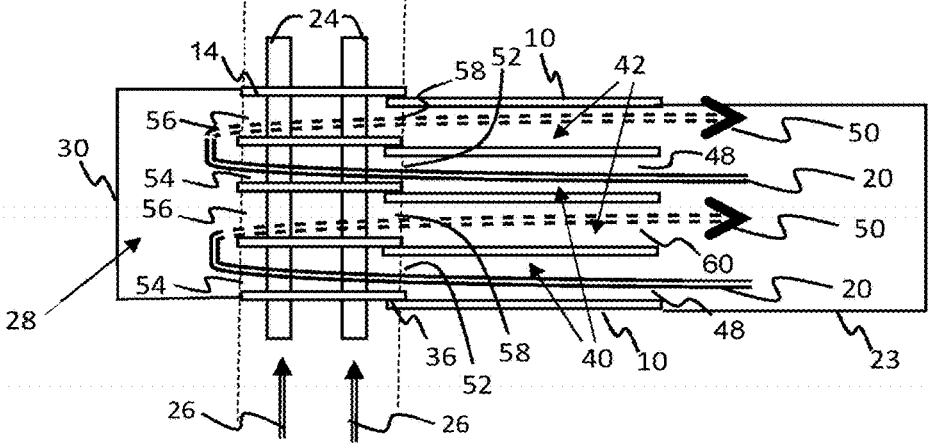
FIG. 2 is a top schematic illustration of a heat exchanger according to some embodiments of the invention.

Reference is now made to FIGS. 1 and 2 which depict a heat exchanger 100 according to some embodiments of the invention.

Heat exchanger 100 may include plates heat exchanger 12, fins and tubes heat exchanger 16, bypass compartment 30, an inlet zone 18 and an outlet zone 22.

The fins and tubes heat exchanger 16 may be coupled to the plates heat exchanger 12. The heat exchanger further comprises a bypass compartment 30 defining an enclosure 28 enclosing at least one side of the fins and tubes heat exchanger 16, the bypass compartment 30 comprising an open side 32 facing the at least one side of the fins and tube heat exchanger 16.

The fins and tubes heat exchanger 16 may be a traditional fins and tubes heat exchanger which comprises a plurality of stacked fins 14, usually made of a material having high thermal conductivity, having through holes 26 through which through tubes 24 pass, the through tubes 24 designed to couple to an external thermal fluid to exchange heat to transfer heat between the external thermal fluid flowing in the tubes 24 and a fluid flowing in between the fins 14.

The plates heat exchanger 12 may comprise a plurality of stacked plates 10 configured to transfer heat from one side of the surface of the plate to the other side of the surface of the plate. The plate heat exchanger faces the inlet zone and an outlet zone of the heat exchanger 100.

Fins 14 of the fins and tubes heat exchanger 16 may be each coupled to a corresponding plate 10 on an edge of the fin 14 and one of the edges of the fin faces the open side 32 of the bypass compartment 30.

Plates 10 of the plates heat exchanger 12 are each coupled to a fin 14 of the fins and tubes heat exchanger 16 on an edge of the plate, one of the edges of the plate 10 faces at least one of the inlet zone 18 and the outlet zone 22.

The plates 10 of the plates heat exchanger 12 can be aligned and sealed with fins 14 of the fins and tubes heat exchanger 16 to define a plurality of continuous fluid pathways 40 and 42 each pathway comprising a pair of coupled plate 10 and fin 14.

In the example depicted in FIGS. 1 and 2 the fins 14 and the plates 10 may overlap but in other embodiments they may be continuously attached at the edges of the fins 14 and the plates 10. The fins and plates can be glued, annealed or attached by any other commonly practiced method.

As can be seen in FIG. 1, the plates heat exchanger 12 faces an inlet zone 18 from which an incoming fluid flow 20 may enter the heat exchanger (HX) 100 and outlet zone 22 from which the fluid 20 may exit the HX 100. A divider surface 23 separates the inlet zone 18 from the outlet zone 22. The divider surface 23 is connected to the plates heat exchanger 12 laterally to the plane of the plates 10. A fluid motivator such as a blower, a fan or a propeller can be placed in the inlet zone 18 to propel the incoming fluid flow 20 and/or in the outlet zone 22 to pull the outgoing fluid flow 50. In some embodiments, the divider surface 23 may not be permanently connected to the plates heat exchanger, but rather is part of the body of the apparatus 1000 which hosts the heat exchanger 100.

Each coupled plate and fin defines a gap (40 or 42) with an adjacent coupled plate and fin. These gaps may either be (i) characterized by having the portion of the gap between two adjacent plates facing the inlet zone 18 being open, and the portion of the gap between two adjacent plates facing the outlet zone 22 being blocked such that the gap defines an inlet pathway 40 or (ii) characterized by having the portion of the gap between two adjacent plates facing the outlet zone 22 being open, and the portion of the gap between two adjacent plates facing the inlet zone 18 being blocked such that the gap defines an outlet pathway 42.

Accordingly, the gaps between two adjacent plates may be alternately open in the inlet zone 18 and blocked in the outlet zone 22 or vice versa—blocked in the in the inlet zone 18 and open in the outlet zone 22. The gaps may be alternately blocked or open in each zone such that on a certain the entire stack of plates 10 is configured to have alternate stacked inlets and outlets.

In some embodiments, the plates 10 are made of low heat-conductive material such as plastic and the fins 14 (as well as the tubes) are made of a high heat conductive material such as a metal or metal alloy. In some embodiments, the plates 10 are made of a material having a thermal conductivity of less than or equal to 5W/m·° C. In some embodiments, the fins 14 are made of a material having a thermal conductivity higher than or equal to 50W/m·° C. In some embodiments, the fins 14 and/or the tubes 24 (vide infra) are made of aluminum, aluminum alloy, copper, copper alloy, or stainless steel. In some embodiments, the plate 10 comprises attaching protrusions dispersed in the peripheral margin area proximate to the edge which overlaps the peripheral margin area of the fin 14 for pressing the fin to an adjacent plate or to the same plate.

In some embodiments the fins 14 may include through holes. The term "through hole" refers to a hole that passes from one side of the article to the other side.

The fins may be penetrated by tubes 24 designed to couple to an external thermal fluid for example by connecting to a refrigeration cycle. The tubes 24 conduct a second (thermal) fluid flow 26 (either hot or cold) that is meant to exchange heat with the fluid flowing through the pathways (i.e in-between the fins and the plates). The fins are attached on one of their edges to the plates. The opposite edge of the fins to the edge which is attached to the plate, faces the bypass zone 28, which is defined by a bypass compartment 30 included in heat exchanger 100. In some embodiments, the bypass compartment 30 is defining an enclosure having an open side 32 facing the side of the fins and tubes heat exchanger 16 being distal to the side 34 of the fins and tubes heat exchanger 16 which is attached to the plates heat exchanger 12. It is noted that the fins can be attached to the plates at their edges or, as in the embodiment depicted in FIGS. 1 and 2, they can be attached through a margin 36 in proximity to the edges. The bypass zone 28 which is defined by the walls of the bypass compartment 30 allows fluid flow 38 (which is the extension of fluid flow 20) exiting fins and tubes heat exchanger 16 from the inlet pathways 40 to reenter the fins and tubes heat exchanger 16 through the outlet pathways 42. Fluid flow 38, might split and re-enter the fin and tube heat exchanger 16 from few other outlet pathways. For the sake of simplicity this split is not shown in FIGS. 1 and 2.

Figure 3:
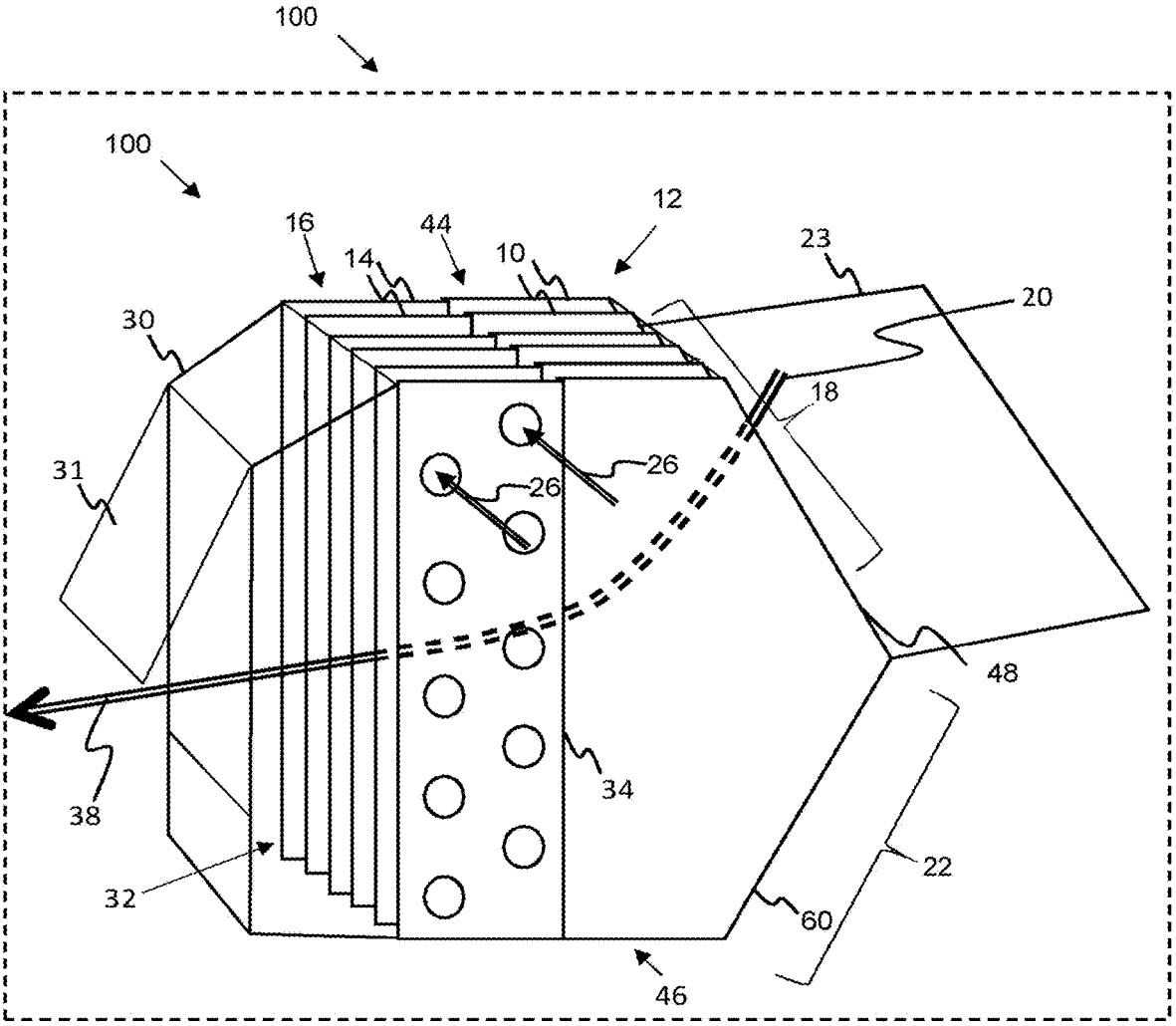
FIG. 3 is an isometric view of an apparatus installed with a heat exchanger having an open shutter allowing cold air to exit the apparatus according to some embodiments of the invention.

The bypass compartment 30 may have a shutter 31. The shutter 31 may be closed as in FIG. 1, open as in FIG. 3 or semi open (not shown). When the shutter is open, it allows at least a portion of the fluid flow 38, in some embodiments essentially all of the fluid flow 38, which exited the fins and tubes heat exchanger 16, to exit the heat exchanger 100, instead of returning to the outlet pathways 42. This portion of the fluid flow 38 thus exits the heat exchanger 100 as cold air instead of exchanging heat with the fluid flow 20 which enters the heat exchanger. As such, the apparatus 1000 may function as an air conditioner with reduced water generation capacity. Switching the shutter 31 between an open state and a closed state allows to switch the apparatus 1000 between two states—a first state functioning as a dehumidifier/water generator when the shutter 31 is closed, and a second state functioning as an air conditioning state when the shutter 31 is open. When the shutter 31 is semi-open, then the apparatus 1000 functions both as a dehumidifier and a water generator. The change from open state to closed state may be continuous, so an operator (or a control unit) can determine the proportion between air conditioning and water generation.

In embodiments having a shutter 31, the apparatus may further comprise a duct having one outlet opening disposed in proximity to the inlet/outlet zones (18, 22) and one inlet opening being disposed at a target space for climate control (e.g. the indoor of a vehicle) to enable a closed circuit air conditioning. The opening of the duct being disposed in the inlet/outlet zone may have a shutter such that when the compartment shutter 31 and the duct shutter are open, and the blower pulls an airflow from the air conditioned space through the duct inlet, through the duct, toward the duct outlet, trough the inlet/outlet zone (18, 22), through the heat exchangers, through the bypass compartment 30 and back to the air conditioned space through the bypass shutter 31.

In some embodiments, an air motivating means such as a fan or blower is positioned at the outlet zone of the heat exchanger and pulls air from the outlet pathways 42. In such embodiments, which also have a shutter 31 as explained above, then when the shutter 31 is in an open state, then the rotation of the propeller of the aforementioned motivating means can be reversed, so fluid flow is pushed into the outlet pathways 42, that now serve as additional inlet pathways. The fluid flow then passes through the plates 10, then the fins 14, where it exchanges heat with the external fluid 26 through fins 14 and tubes 24, exits the fins and tubes heat exchanger 16 and combines with fluid flow 38 arriving from the inlet pathways 40 to exit the apparatus 1000 as cold/hot air.

The top 44 and bottom 46 sides of the heat exchanger 100 are blocked. In some embodiments, a portion of the top 44 and/or bottom 46 sides of the fins and tubes heat exchanger can be at least partially open to the bypass compartment 30. In such embodiments, the bypass compartment 30 allows the fluid flow 38 to exit the inlet pathway 40 and reenter the outlet pathway 42 through fins and tubes heat exchanger portion of the top 44 and/or the bottom sides 46.

When the heat exchanger 100 is operating, the fluid flow 20 thus enters the heat exchanger 100 (with assistance of motivating means such as a blower or a pump) via first inlets 48 of the plates heat exchanger 12 in an inlet zone 18 of the heat exchanger 100, continues to flow through the inlet pathways 40 where it is confined by two plates 10 of the plates heat exchanger 12 and is in heat exchange with the fluid 50 that flows in the outlet pathways 42 on either side of the inlet pathway 40. The fluid flow 20 then enters the portion of the inlet pathway 40 in the fins and tubes heat exchanger 16, by passing the first outlets of the plates heat exchanger/first inlets of the fins 52. In the fins and tubes portion of the inlet pathway 40, the fluid flow 20 indirectly exchanges heat with the external thermal fluid 26 flowing in the tubes 24. The fluid flow 20 then exits the fins through the first outlet of the fins 54, enters the bypass zone 28 as fluid flow 38, where it is confined by the open sided bypass compartment 30. The fluid flow 38 then reenters the fins and tubes heat exchanger 16 through its second set of inlets 56 into the outlet pathways 42 as fluid flow 50. Fluid flow 50 exchanges heat with the external thermal fluid 26 and exits the fins and tubes portion of the outlet pathways 42 through the second fins outlets/second plates inlets 58. The fluid flow 50 then flows in the plates heat exchanger portion of the outlet pathway 42 where it exchanges heat with the incoming fluid 20 flow on either side of the outlet pathway 42 through the plates 10. Finally, the fluid flow leaves the heat exchanger via the second set of outlets 60 of the plates heat exchanger 12 to an outlet zone 22 of heat exchanger 100.

Accordingly, when the fins and tubes is coupled to a cooling source the fluid in the inlet pathway 40 is precooled upstream of the fins and tubes heat exchanger 16 while the fluid in the outlet pathway 42 is post-heated downstream of said fins and tubes heat exchanger 16. When the fins and tubes is coupled to a heating source, (e.g. when the apparatus operates as an AC on heating mode) the fluid in the inlet pathway 40 is preheated upstream of the fins and tubes heat exchanger 16 while the fluid in the outlet pathway 42 is post-cooled downstream of said fins and tubes heat exchanger 16.

The heat exchange between the incoming fluid flow 20 to the outgoing fluid flow 50 increases the energy efficiency of the heat exchange process as the fluid flow that exchanges heat with the external thermal fluid 26 is already closer to the temperature of the thermal fluid 26 due to the exchange of heat with the outgoing airflow.

The heat exchanger of the invention can be prepared according to ordinary production methods available in the art.

The configuration described above is less space consuming in comparison to other prior art heat exchangers, such as those described in international patent application PCT/IL2018/051266. This allows utilizing this technology for various applications which were not conceived yet so far especially in confined spaces such as on a kitchen countertop, a bathroom or a ceiling duct.

The heat exchanger may be located inside an apparatus. The apparatus can be an AWG, an AC unit a dehumidifier or a pasteurizing device. The fluid can be air such as humid air to be dried, air comprising solvent vapors to be regenerated or a liquid such as milk to pasteurized. A person of skill in the art would know how to make the necessary adjustments in order to incorporate the heat exchanger of the invention as part of the specific apparatus. The apparatus can function as an air conditioner when the shutter is an open state, as an AWG when the shutter is in closed state and bot as an A/C and an AWG when the shutter is on semi-open state.

In some embodiments, the apparatus is a hybrid A/C—AWG system that can be installed for example in a vehicle, which can switch between an AC mode, an AWG mode and a concomitant AC and AWG mode by selecting the state of the shutter in the bypass compartment between open state, closed state and semi open state, respectively.

The invention claimed is:

1. A heat exchanger comprising:

a fins and tubes heat exchanger, comprising a plurality of stacked fins penetrated by tubes designed to couple to an external thermal fluid, the fins being configured to transfer heat between the external thermal fluid flowing in the tubes and a fluid flowing in between the fins; a plates heat exchanger comprising a plurality of stacked plates configured to transfer heat from one side of the surface of the plate to the other side of the surface of the plate;

a bypass compartment defining an enclosure enclosing at least one side of the fins and tubes heat exchanger, the bypass compartment comprising an open side facing the at least one side of the fins and tube heat exchanger;

an inlet zone; and an outlet zone;

wherein, the fins and tubes heat exchanger being coupled to the plates heat exchanger such that fins of the fins and tubes heat exchanger are each coupled to a corresponding plate on an edge of the fin and one of the edges of the fin faces the open side of the bypass compartment, plates of the plates heat exchanger are each coupled to a fin of the fins and tubes heat exchanger on an edge of the plate, one of the edges of the plate faces at least one of the inlet zone and the outlet zone, each coupled plate and fin defines a gap with an adjacent coupled plate and fin, and either (i) the portion of the gap between two adjacent plates facing the inlet zone is open, and the portion of the gap between two adjacent plates facing the outlet zone is blocked such that the gap defines an inlet pathway or (ii) the portion of the gap between two adjacent plates facing the outlet zone is open, and the portion of the gap between two adjacent plates facing the inlet zone is blocked such that the gap defines an outlet pathway, the inlet pathways and outlet pathways being alternately stacked, enabling the fluid in the inlet pathway and the fluid in the outlet pathway to be in mutual heat exchange propinquity.

2. The heat exchanger according to claim 1 further comprising a divider surface separating the inlet zone from the outlet zone and connected to the plates heat exchanger laterally to the plane of the plates.

3. The heat exchanger according to claim 1 wherein the fins and tubes heat exchanger is coupled to a cooling source such that the fluid in the inlet pathway is precooled upstream of said fins and tubes heat exchanger by exchanging heat with a fluid in the outlet pathway while a fluid in the outlet pathway is post-heated downstream of said fins and tubes heat exchanger by exchanging heat with the fluid in the inlet pathway.

4. The heat exchanger according to claim 1 wherein the fins and tubes heat exchanger is coupled to a heating source such that the fluid in the inlet pathway is preheated upstream of said fins and tubes heat exchanger by exchanging heat with a fluid in the outlet pathway while a fluid in the outlet pathway is post-cooled downstream of said fins and tubes heat exchanger by exchanging heat with the fluid in the inlet pathway.

5. The heat exchanger according to claim 1 wherein plates of the plates heat exchanger are aligned and sealed with fins of the fins and tubes heat exchanger to define a plurality of continuous fluid pathways each pathway comprising a plate and a fin.

6. The heat exchanger according to claim 1 wherein the bypass compartment is in proximity to the fins and tube heat exchanger and distal from the plates heat exchanger.

7. The heat exchanger according to claim 1 wherein the plates of the heat exchanger are made of a material having lower thermal conductivity than the material the fins are made of.

8. The heat exchanger according to claim 1 configured to enable counter flow of the fluid flowing in the inlet pathway with the fluid flowing in the outlet pathway.

9. The heat exchanger according to claim 1 wherein the compartment further comprising a shutter.

10. The heat exchanger according to claim 9 wherein the shutter is adapted to be in an open, closed or semi-open state.

11. An apparatus comprising a housing, the heat exchanger defined in claim 1 and a fluid propagating means wherein the housing accommodates the heat exchanger and the propagating means.

12. The apparatus according to claim 11 being a dehumidifier.

13. The apparatus according to claim 11 further comprising a blower for motivating air, a sump for collecting water condensing in the heat exchanger and means for treating and distributing said condensate water, and a blower and being an atmospheric water generator.

14. The apparatus according to claim 11 further comprising a separation plate adapted to separate the inlet zone from the outlet zone.

15. The apparatus according to claim 11 wherein the apparatus functions as an air conditioner when the shutter is an open state, as an AWG when the shutter is in closed state and bot as an A/C and a AWG when the shutter is on semi-open state.

* * * * *